US007081833B2

(12) United States Patent
Jo

(10) Patent No.: US 7,081,833 B2
(45) Date of Patent: Jul. 25, 2006

(54) SPEED VIOLATION CONTROL SYSTEM USING DEDICATED SHORT-RANGE COMMUNICATION

(75) Inventor: Yeong-Su Jo, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 406 days.

(21) Appl. No.: 10/731,719

(22) Filed: Dec. 8, 2003

(65) Prior Publication Data

US 2004/0257245 A1 Dec. 23, 2004

(30) Foreign Application Priority Data

Jun. 11, 2003 (KR) ..... 10-2003-0037525

(51) Int. Cl.
*G08G 1/01* (2006.01)

(52) U.S. Cl. ..... 340/936; 340/905; 340/441

(58) Field of Classification Search ..... None
See application file for complete search history.

(56) References Cited

U.S. PATENT DOCUMENTS 4,591,823 A 5/1986 Horvat
5,164,904 A * 11/1992 Sumner ..... 701/117
5,187,810 A * 2/1993 Yoneyama et al. ..... 455/509
5,381,155 A * 1/1995 Gerber ..... 342/104
5,805,079 A * 9/1998 Lemelson ..... 340/870.05
5,819,198 A 10/1998 Peretz
5,952,941 A 9/1999 Mardirossian
6,046,686 A 4/2000 Mitchell et al.
6,073,062 A * 6/2000 Hoshino et al. ..... 701/3
6,121,898 A 9/2000 Moetteli
6,166,658 A * 12/2000 Testa ..... 701/93
6,462,675 B1 * 10/2002 Humphrey et al. ..... 340/905
6,580,374 B1 * 6/2003 Schrage ..... 340/933
6,606,033 B1 * 8/2003 Crocker et al. ..... 340/901
6,845,317 B1 * 1/2005 Craine ..... 701/200
6,864,784 B1 * 3/2005 Loeb ..... 340/441
6,917,290 B1 * 7/2005 Land ..... 340/539.1

* cited by examiner

*Primary Examiner*—Benjamin C. Lee
(74) *Attorney, Agent, or Firm*—Morgan Lewis & Bockius LLP

(57) ABSTRACT

A speed violation control system using a dedicated short-range communication comprises Road-Side Equipment for transmitting the speed information of a vehicle and for receiving processed results and On-Board Equipment mounted inside the vehicle to transmit the speed information of the vehicle to the RSE and then receive the processed result from the RSE. The system notifies a driver of certain control details in real time and prevents vehicle accidents in advance via warning messages when the vehicle exceeds a safe speed zone, thus eliminating the manpower needed to examine photographs of speeding vehicles.

3 Claims, 2 Drawing Sheets

SPEED VIOLATION CONTROL SYSTEM USING DEDICATED SHORT-RANGE COMMUNICATION

CROSS-REFERENCE TO RELATED APPLICATIONS

This application claims of Korean Application No. 10-2003-0037525, filed on Jun. 11, 2003, the disclosure of which is incorporated fully herein by reference.

FIELD OF THE INVENTION

The present invention relates to a speed violation control system using a dedicated short-range communication (DSRC) and, more particularly, to a system adapted to effectively check the state of a moving vehicle by using the DSRC to thereby warn or control a driver in relation to the speed of the vehicle.

BACKGROUND OF THE INVENTION

There are a number of ways that speed limits are currently enforced. For example, a vehicle that exceeds a legal speed limit can be detected via a speed camera, which is installed above a roadway for photographing the license plate of a speeding vehicle and reading it at a traffic information center. More traditionally, a police officer may directly issue a speeding ticket to the speeder based on a speed detector, such as a radar gun.

However, there is a drawback in the conventional speed violation control systems in that examining photographs taken via the speed camera and the use of police officers to monitor speeding vehicles result in increased labor costs and manpower.

SUMMARY OF THE INVENTION

Embodiments of the present invention provide a system adapted to detect the state of a moving vehicle using DSRC to thereby effectively warn or control a driver in relation to the speed of a vehicle.

In one embodiment of the present invention, a speed violation control system using a DSRC comprises Road-Side Equipment (RSE) for transmitting the information of the vehicle speed and for receiving the processed results. On-Board Equipment (OBE) mounted inside a vehicle transmits the information of the vehicle speed to the RSE and then receives the processed result from the RSE. An Electronic Control Unit (ECU) receives the information of the vehicle speed from a speed detecting sensor in order to output it to the OBE and to reproduce the processed result inputted from the OBE in a voice format via a voice output means. A traffic information center analyzes the information of the vehicle speed received from the RSE and then outputs the processed result, according to the analysis, to the RSE.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

The preferred embodiment of the present invention will now be described in detail with reference to the accompanying drawings.

Figure 1:
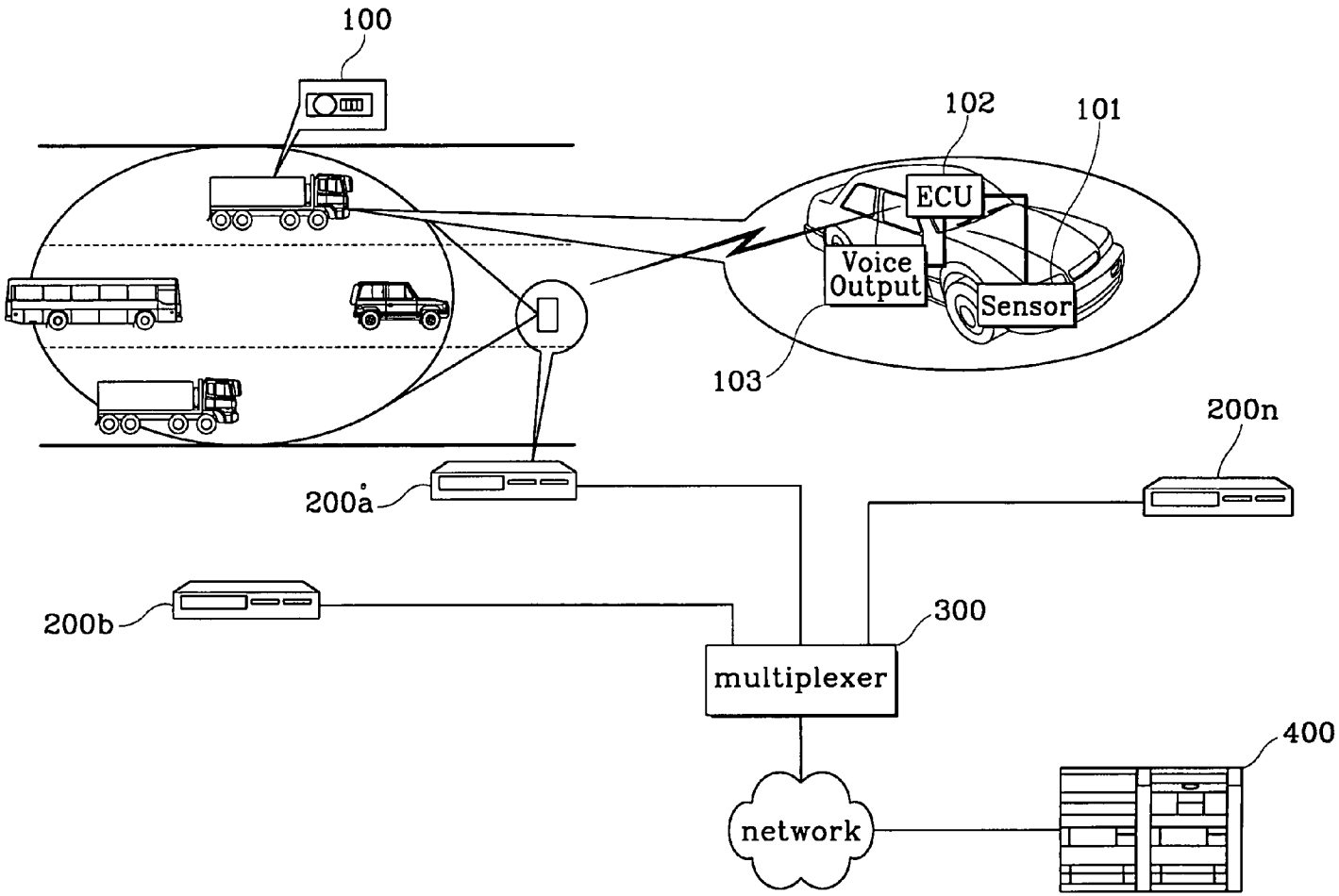
FIG. 1 illustrates a configuration of a speed violation control system according to an embodiment of the present invention.
Figure 2:
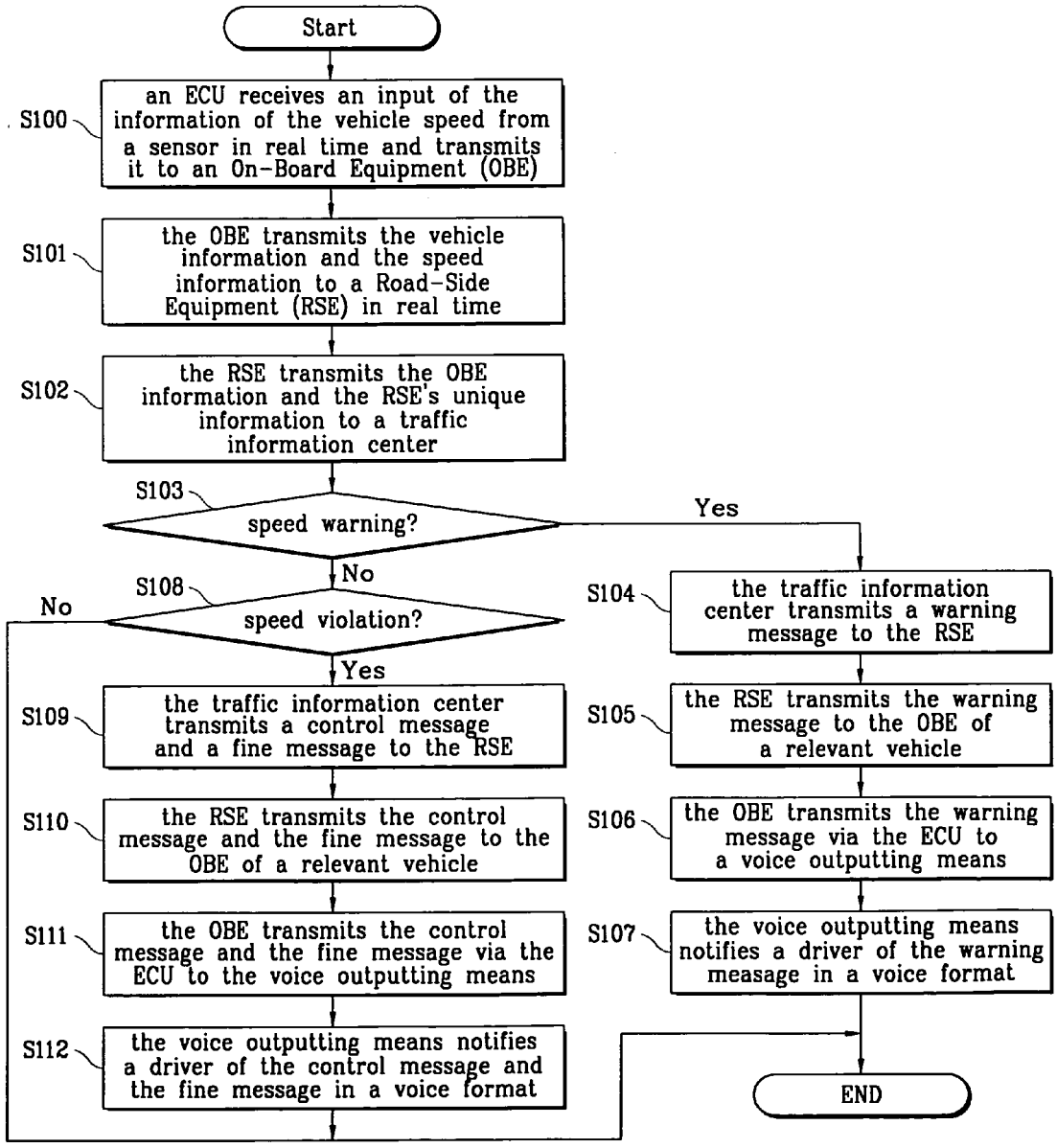
FIG. 2 is a flowchart illustrating an operational procedure of the speed violation control and the warning according to an embodiment of the present invention.

As shown in FIG. 1, a speed violation control system according to the present invention comprises a vehicle speed sensor 101, an ECU 102, a voice outputting means 103, and an OBE 100, that are all installed inside the vehicle. ECU 102 may comprise a processor and associated hardware and software as may be selected and programmed by a person of ordinary skill in the art.

The vehicle speed sensor 101 detects a vehicle speed and inputs it to the ECU 102. The voice outputting means 103 is designed to reproduce a voice message inputted from the ECU 102, for example a warning message, a fine message, a control message or the like. Voice outputting means 103 may comprise a speaker and other associated hardware appropriately driven by ECU 102 as may be configured by a person of ordinary skill.

The ECU 102 receives the vehicle speed from the vehicle speed sensor 101 and outputs it to the OBE 100. The ECU 102 then inputs a message (a warning message, a fine message, a control message or the like) that is inputted from the OBE 100, to the voice outputting means 103 for reproducing it in a voice format.

The OBE 100 transmits the vehicle's unique information and the information of the vehicle speed, which is inputted from the ECU 102, to the RSE 200*a*–200*n*. The OBE 100 then receives the processed result regarding the vehicle speed (e.g., warning message, fine message, control message or the like) from the RSE 200*a*–200*n* and then inputs it to the ECU 102. OBE 100 and RSE 200*a*–200*n* generally communicate via radio transmissions. Each may include transceivers and other hardware and software as may be selected and programmed by persons of ordinary skill in the art based on the teachings contained herein. In a preferred embodiment the OBE and RSE communicate via 5.8 GHz radio communication. In such an embodiment the transmission speed and distance are 1 Mbps and about 200 m, respectively.

The RSE 200*a*–200*n* transmits the information of the vehicle speed and the vehicle's unique information delivered from the OBE 100 as well as the unique information of the RSE to a traffic information center 400. The RSE 200*a*–200*n* then receives the processed result of the vehicle speed from the traffic information center 400 and transmits it to the relevant OBE 100 by using the vehicle's unique information.

The traffic information center 400 analyzes the information of the vehicle speed received from the RSE 200*a*–200*n* and then transmits the processed result (e.g., warning message, fine message, control message or the like) according to the analysis, to the relevant RSE 200*a*–200*n* by way of using the RSE's unique information. The traffic information center 400 communicates with a plurality of the RSE 200*a*–200*n* via a multiplexer 300.

The operational procedure according to an embodiment of the present invention will now be described.

The ECU 102 receives the input of the information of the vehicle speed from the vehicle speed sensor 101 in real time for transmitting it to the OBE 100 (S100).

The OBE 100 transmits the pre-saved vehicle's unique information (license number, for instance) and the information of the vehicle speed inputted from the ECU 102 to the RSE 200*a*–200*n* in real time (S101).

The RSE 200*a*–200*n* transmits the information delivered from the OBE 100 as well as the RSE's unique information to the traffic information center 400 (S102).

The traffic information center 400 examines the OBE information (vehicle information and speed information) and the RSE information (RSE's unique information) and determines whether the speed of a vehicle is in the scope of a warning speed (e.g., when a vehicle is moving at 90–100 km/hr in a 100 km/hr speed limit zone) (S103). If the vehicle is within the warning speed zone, the traffic information center 400 transmits a warning message to the relevant RSE 200*a*–200*n* (S104).

The RSE 200*a*–200*n* transmits the warning message to the OBE 100 of the relevant vehicle (S105). The OBE 100 transmits the warning message via the ECU 102 to the voice outputting means 103 (S106). The voice outputting means 103 informs a driver of the warning message in a voice format (S107).

If the vehicle does not reach the warning speed range as a result of step S103, the vehicle is examined whether it exceeds the speed limit (e.g., 100 km/h), and if so, a fine message and a control message are transmitted to the relevant RSE 260*a*–200*n* (S108, S109). Then, the RSE 200*a*–200*n* transmits the fine message and the control message to the OBE 100 of the relevant vehicle (S110).

The OBE 100 transmits the fine message and the control message via the ECU 102 to the voice outputting means 103 (S111). The voice outputting means 103 notifies the driver of the fine message and the control message in a voice format (S112).

Embodiments of the present invention may be applied in other various systems as long as the claims, detailed description, and attached drawings are in the scope of the present invention.

As apparent from the foregoing, there is an advantage in the speed violation control system using a dedicated short-range communication in that the present invention notifies a driver of certain control details in real time and prevents vehicle accidents in advance via warning messages when the vehicle exceeds a safe speed zone, thus eliminating the manpower needed to examine photographs of speeding vehicles.

What is claimed is:

1. A speed violation control system using dedicated short-range communication, comprising:

Road-Side Equipment (RSE) for transmitting information regarding vehicle speed and for receiving processed results;

On-Board Equipment (OBE) mounted inside a vehicle for transmitting information regarding vehicle speed to said RSE and for receiving the processed result from said RSE;

an Electronic Control Unit (ECU) for receiving the information regarding the vehicle speed from a speed detecting sensor to output it to said OBE and to reproduce the processed result inputted from said OBE in a voice format via a voice output means; and a traffic information center for analyzing the information of the vehicle speed received from said RSE and outputting the processed result to said RSE according to the analysis.

2. The system as defined in claim 1, wherein the traffic information center determines whether the speed of a vehicle transmitted from said RSE is in the scope of a warning speed range, and if so, transmits a warning message to said RSE.

3. The system as defined in claim 1, wherein the traffic information center determines whether the speed of the vehicle transmitted from said RSE exceeds a speed limit, and if so, transmits a fine message and a control message to said RSE.

* * * * *